US005775429A

United States Patent [19]

Arizmendi et al.

[11] Patent Number: 5,775,429

[45] Date of Patent: Jul. 7, 1998

[54] DOWNHOLE PACKER

[75] Inventors: Napoleon Arizmendi, Magnolia; Timothy Tips, Spring, both of Tex.

[73] Assignee: PES, Inc., The Woodlands, Tex.

[21] Appl. No.: 792,404

[22] Filed: Feb. 3, 1997

[51] Int. Cl.[6] ..... E21B 33/12

[52] U.S. Cl. ..... 166/387; 166/196; 166/206

[58] Field of Search ..... 166/187, 196, 166/206, 212, 387

[56] References Cited

U.S. PATENT DOCUMENTS

| | | | |
|---|---|---|---|
| 4,951,747 | 8/1990 | Coronado | 166/187 |
| 4,960,181 | 10/1990 | Marin et al. | 166/212 X |
| 4,979,570 | 12/1990 | Mody | 166/187 X |

*Primary Examiner*—Roger J. Schoeppel

[57] ABSTRACT

A packer for sealing a space downhole in a well. The packer includes a deformable sheath having a body and first and second ends for defining an interior volume proximate to a tool surface. A material located within the interior volume is deformable, when the sheath second end is moved toward the sheath first end, to move the deformable sheath into the downhole space. The sheath can function as a sealing element or a backup element, and can be applied to different structures and tool configurations downhole in a wellbore. For example, the packer can be applied to plugs, to through tubing mandrals, and to other well tools in open hole or in cased wellbore configurations. The packer resists damage to the seal elements, provides confirmation of the packer setting force, and is less expensive than conventional packer designs.

19 Claims, 8 Drawing Sheets

DOWNHOLE PACKER

BACKGROUND OF THE INVENTION

The present invention relates to the field of downhole packers. More particularly, the present invention relates to a new packer for closing the space between downhole well components or between well tubing and a wellbore casing or borehole wall surface.

Downhole packers seal the annulus between well tubing and the borehole or between well tubing and casing set in the wellbore. By sealing such annulus, hydrocarbon producing zones can be isolated from other regions within a wellbore, thereby preventing migration of fluid or pressure from one zone to another.

Packers typically comprise permanent or retrievable packers. Permanent packers are installed in the wellbore with mechanical compression setting tools, with fluid pressure devices, with inflatable charges, or cement or other materials pumped into an inflatable seal element. Because of the difficulty of removing permanent packers, retrievable packers have been developed to permit the deployment and retrieval of the packer from a particular location within the wellbore.

Conventional packers typically comprise a sealing element between upper and lower retaining rings or elements. U.S. Pat. No. 4,753,444 to Jackson et al. (1988) disclosed a packer having a conventional sealing element located around the outside of a mandrel. Anti-extrusion rings and back-up rings contained the seal element ends and were compressed to radially expand the seal element outwardly into contact with the well casing. U.S. Pat. No. 4,852,649 to Young (1989) disclosed packers having multiple moving packer elements which distributed stresses across the elements as the packer elements expanded to seal the wellbore annulus. In U.S. Pat. No. 5,046,557 to Manderscheid (1991), multiple seal elements were separated with spacers around the exterior surface of a mandrel. The seal elements were hydraulically set to contact the well casing.

Other concepts have been developed for specific seal requirements. In U.S. Pat. No. 5,096,209 to Ross (1992), voids were incorporated within sealing elements to modify the performance of the seal elements in the sealing gaps between multiple tubing elements. In U.S. Pat. No. 5,195,583 to Toon et al. (1993), bentonite was placed within a packer element so that contact with water caused seal element expansion to form a low pressure annular seal.

U.S. Pat. No. 5,467,822 to Zwart (1995) disclosed a fluid pressure set pack-off tool wherein a seal element was retained with rings and annular inserts. Coaxial springs reduced distortion of the seal element and facilitated retraction of the seal element following removable of the fluid pressure. Radial bores through the seal element prevented entrained air from distorting the seal element and further permitted a higher pressure to press the seal element into sealing engagement with the well casing.

Conventional packers are limited by certain factors. It is difficult or impossible to ascertain whether a packer has been completely set, or if the packer provides an effective seal within the wellbore. This is particularly true in open hole packer applications where the borehole has washed out to create a borehole diameter greater than the drill bit diameter.

Permanent packers are typically set with a selected pump pressure. Such pressure does not reliably provide confirmation that the packer has provided an effective seal within the wellbore. Even after "permanent" packers have been initially set, the packing element can shrink as concrete or other packer setting fluids shrink or leak from the packer interior, thereby losing the sealing effectiveness. Additionally, retrievable packers can lose sealing effectiveness as temperatures cycle or fluctuate within the wellbore. High well temperatures relax many sealing materials, and the pressure set between the seal material and the well casing will deteriorate.

Another disadvantage of conventional packers is that the exterior sealing element travels on the packer exterior from the well surface to the downhole location. When the packer is run thousands of meters into the wellbore, the packing seal can abrade or completely swab off the packer sleeve. This failure may not be detected until the packer is set and the pressure containment of the isolated zone fails.

In addition, conventional packers do not readily conform to irregularities in a wellbore. To provide sufficient strength to seal large downhole fluid pressures, conventional packers are constructed as composite devices which can expand in one radial direction. Such packers do not effectively conform to elliptical or oval-shaped wellbores and do not provide an effective fluid tight seal within the wellbore.

Accordingly, a need exists for an improved packer that avoids the disadvantages of conventional packers and provides a reliable seal between different components and features downhole in a wellbore.

SUMMARY OF THE INVENTION

The present invention provides an apparatus and method for filling the space proximate to a tool surface downhole in a wellbore. The apparatus comprises a deformable sheath having a first end proximate to the tool surface, a second end proximate to the tool surface and moveable toward the sheath first end, a sheath body for defining an interior space between the tool surface and the sheath first and second ends, and a deformable material for moving the sheath body into the wellbore space when the sheath second end moves toward the sheath first end.

In another embodiment of the invention, the apparatus includes a first retainer proximate to the tool surface, a second retainer proximate to the tool surface which is moveable toward the first retainer, a deformable sheath having a first end connected to the first retainer and a second end connected to the first retainer for defining an interior volume between the sheath and tool surface and first and second retainers, and a material within the interior volume for deforming, when the second retainer moves toward the first retainer, to move the sheath into the space proximate to the tool surface.

In other embodiments of the invention, a sleeve having an exterior surface is positionable downhole in a wellbore. The sleeve exterior surface, a deformable sheath and first and second retainers define an interior space containing a deformable material. Movement of the second retainer toward the first retainer causes the material to deform the sheath into the wellbore space.

The method of the invention of filling a space downhole in a borehole is practiced by positioning a deformable sheath proximate to a tool surface downhole in the borehole to define an interior space between the tool surface, a body of the sheath, and first and second ends of the sheath proximate to the tool surface, of placing a deformable material within said interior space, and of moving the sheath second end toward the sheath first end to deform the material to move the sheath body into the space.

DESCRIPTION OF THE PREFERRED EMBODIMENTS

The present invention provides an apparatus and method for expanding a packing element into a downhole well space. The invention can comprise a packer seal, a backup element for a packer seal, or other function applicable to filling the space between a tool and the borehole wall or casing within the borehole, or between different tool surfaces.

Figure 1:
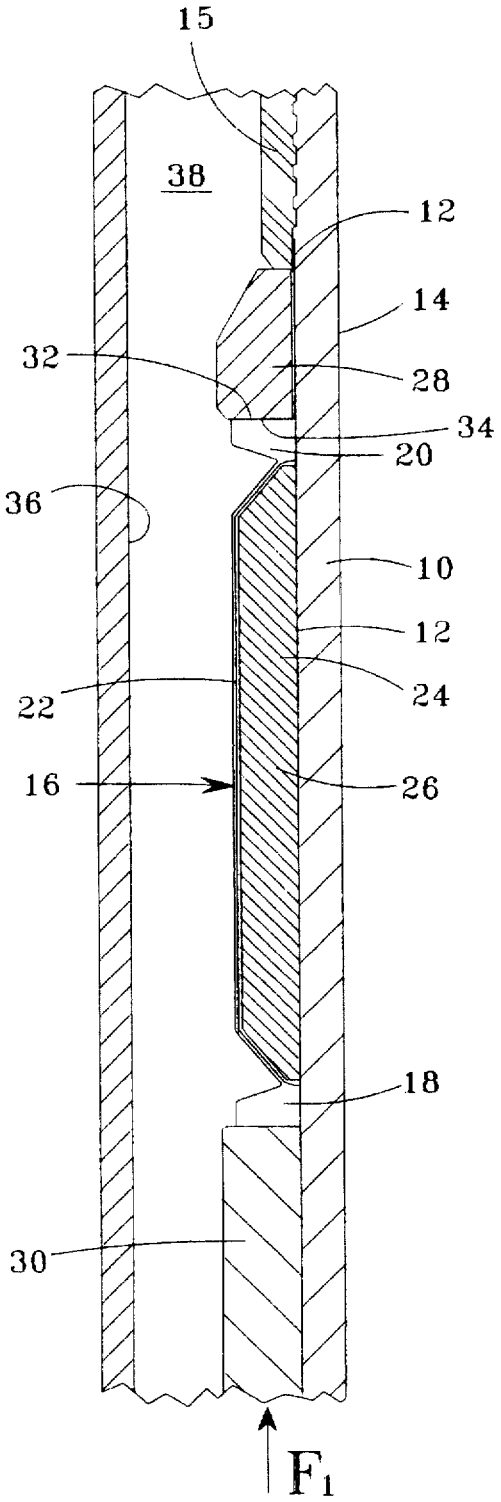
FIG. 1 illustrates a deformable sheath having a body, a sheath first end, and a sheath second end proximate to a tool surface.

Referring to FIG. 1, one embodiment of the invention is illustrated in partial cross-section. Mandrel 10 has exterior surface 12 and interior surface 14. Mandrel 10 is threadably connected to tubing 15. Deformable sheath 16 has first end 18 proximate to tool surface 12, second end 20 proximate to tool surface 12, and body 22 between first end 18 and second end 20. Sheath 16 defines interior volume 24 between tool exterior surface 12, body 22, first end 18 and second end 20. Deformable material 26 is positioned within interior volume 24 and ring 28 can be positioned between sheath second end 20 and tubing 15.

Figure 2:
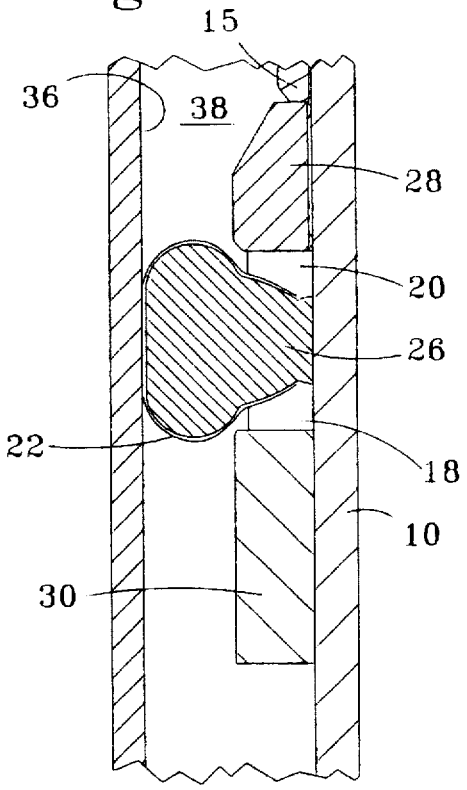
FIG. 2 illustrates the sheath after the second end has been moved toward the sheath first end.

FIG. 2 illustrates the operation of sheath 16 and material 26 in response to Force $F_1$. Force $F_1$ is provided by setting tool 30 to move sheath first end 18 toward sheath second end 20. Movement of sheath second end 20 is restrained by the opposing force exerted by ring shoulder 32 against second end 20. As sheath first end 18 moves toward sheath second end 20, body 22 deforms away from mandrel surface 12 until body 22 contacts casing wall 36 downhole in a wellbore. In an open hole wellbore, body 22 would move outwardly until contact was made with the wellbore surface. Such deformation of body 22 occurs not only from the relative movement between sheath second end 20 toward sheath first end 18, but also from the force exerted on body 22 by material 26.

Force $F_1$ can be furnished by any setting tool capable of applying the requisite force against first end 18. The opposing force counteracting the setting force $F_1$ is provided by ring 28 in contact with tubing 15. Alternatively, such opposing force can be provided by the weight of tubing or other components, by friction between such components and casing wall 36, or by slips or another packer located in wellbore 32. In another embodiment of the invention, the opposing force can be provided by a detachable tool run in wellbore 32 which provides a force counteracting Force $F_1$.

Sheath body 22 is illustrated in FIG. 1 as a relatively thin walled tubular member formed from stainless steel, titanium, or other material having sufficient strength and elasticity to bend without fracturing. Although the thickness of body 22 is illustrated as being relatively uniform in thickness, body 22 can be designed so that the thickness of body 22 varies or is shaped in different configurations with grooves, ridges, indentations, or protrusions to modify the deformation performance of body 22 as second end 20 moves toward first end 18. Different shapes will cause body 22 to conform to variations in the shape of wellbore. Body 22 can be constructed with a size and material which creates a permanent set position which stabilizes mandrel 10 relative to wellbore, and wherein the setting force between body 22 and wellbore does not relax or shrink over time due to tool 10 movement, thermal fluctuations within wellbore, or other factors adversely affecting the performance of conventional packer systems.

Deformable material 26 is positioned within interior volume 24 to control the deformation of body 22. In the absence of material 26, body 22 might tend to buckle, crimp or otherwise bend in a nonuniform manner. In a preferred embodiment of the invention, material 26 deforms to uniformly transfer the motive force from Force $F_1$ uniformly against body 22. In this embodiment of the invention, the deformation of body 22 depends less on the mass and structure of body 22 than on the plastic performance of material 26. This feature of the invention provides the benefit of permitting a relatively thin-walled body 22 to be used, thereby providing significant plastic deformation without failure due to internal stresses within body 22. This deformation flexibility permits many unique applications of the invention, such as in the application to oval shaped boreholes as described below.

Figure 3:
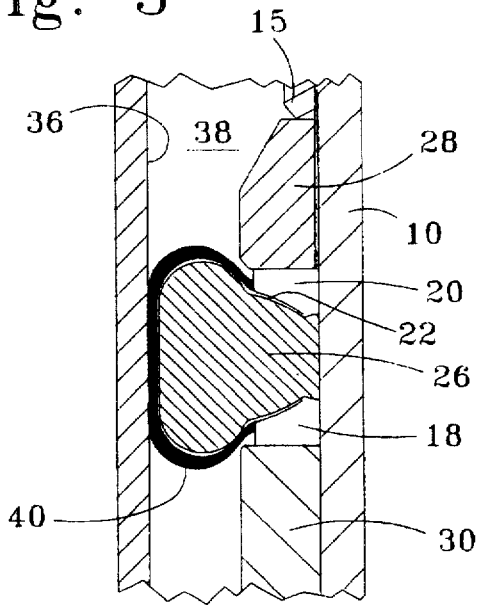
FIG. 3 illustrates one embodiment of the invention wherein a resilient material is attached to the exterior surface of the sheath body.

FIGS. 1 and 2 illustrate the application of the invention to fill a space downhole in a wellbore, such as in centralizers or backup rings for packer seal elements. FIG. 3 illustrates another embodiment of the invention wherein resilient material 40 is attached to body 22. When body 22 is deformed in the set position, resilient material 40 flexes or compresses to seal a gap between body 22 and the wall of wellbore 32. In this embodiment of the invention, body 22 and resilient material 40 cooperate to provide a unique packer element between tool surface 12 and wellbore 32.

Figure 4:
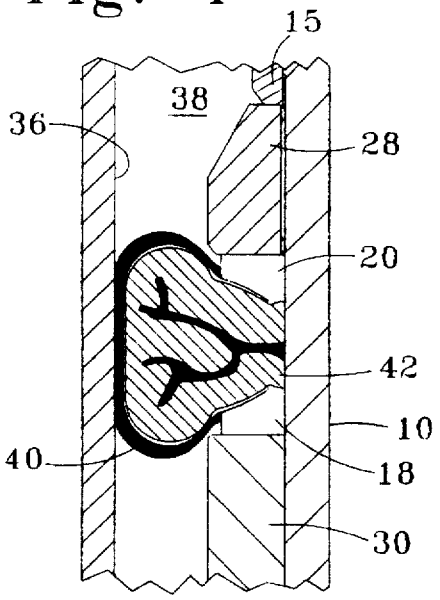
FIGS. 4 through 6 illustrate different forms of deformable material within the sheath interior volume.
Figure 5:
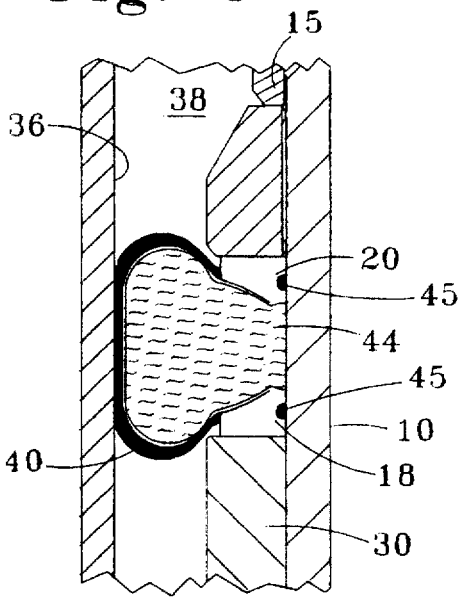
Figure 6:
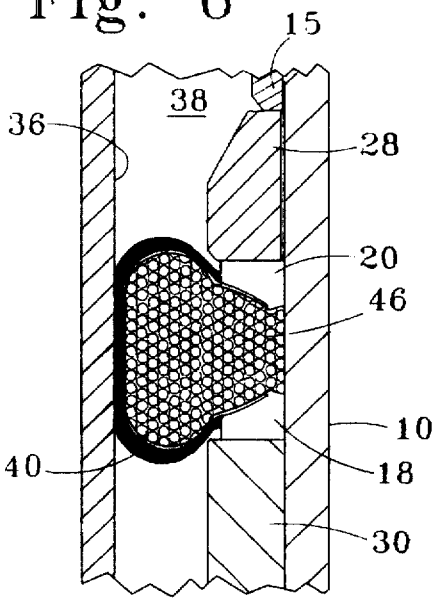

FIGS. 4 through 6 illustrate different materials and material structures suitable to perform the function of material 26. FIG. 4 shows an elastomeric or organic material 42 within interior volume 24. FIG. 5 shows a fluid, gel or liquid material 44 such as oil, gas, or other homogeneous material within interior volume 24. O-ring seals 45 prevent leakage of material 45 from interior volume 24. FIG. 5 shows a material such as a sintered material, loose particles, or pellets 46 within interior volume 24. Pellets 46 can be metallic, ceramic, plastic, or another suitable material. Seals 48 can contain deformable material 26 within interior volume 24. In all of these embodiments, deformable material 26 is reconfigured to assist in the deformation of sheath body 22. Depending on various factors, deformable material 26 can resist nonuniform buckling or other deformation of body 22. In another embodiment of the invention, deformable material 26 can provide a positive, active force against body 22 to cause the deformation of body 22. The shape, composition, placement, and compressibility or noncompressibility of deformable material 26 will affect the deformation of body 22 and sheath 16.

In addition to the inventive embodiments shown in FIGS. 4–6, it will be appreciated that other deformable compounds and material structures can provide the functions described above. Material 26 can be nonsetting or can harden to provide additional support for body 22 after body 22 is deformed into the set position. Material 26 can be noncompressible or moderately or significantly compressible, provided that material 26 is sufficiently dense to transfer deformation forces to body 22 or to prevent undesirable deformation of sheath body 22. Material 26 preferably fills substantially all of interior volume 24 in a preferred embodiment of the invention to lessen collapsibility of interior volume 24 during the setting of the apparatus as body 22 is deformed into the downhole space. However, material 26 could contain voids in certain embodiments of the invention to direct the concentration of force acting against body 22 during setting of the apparatus or for other purposes. While material 26 is illustrated as a relatively homogeneous material within interior volume 24, material 26 could be formed with multiple or composite compounds or structures having different mass, density, shear strength, or other physical or chemical characteristics.

Figure 7:
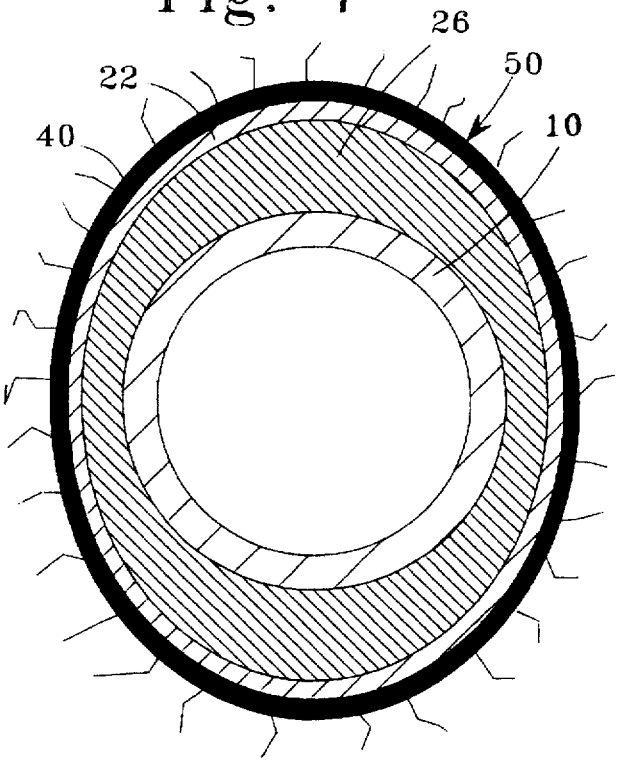
FIG. 7 illustrates the invention installed in an elliptical or oval shaped borehole.

The deformation of material 26 provides for deformation of body 22 in different shapes and directions. As an inflated balloon would expand to fill an adjacent space, the relatively thin wall of sheath body 22 and attached resilient material 40 expand into the mold form provided by casing surface 36 or other constraining structure proximate to mandrel 10. Referring to FIG. 7, substantially horizontal wellbore surface 50 is has an elliptical or oval cross-sectional shape instead of a circular sectional profile. This configuration can occur for many reasons, such as in soft geologic formations where the weight of the drill bit and drill string pushes downwardly to create an eccentric or misshapen wellbore surface 50, or in other drilling operations where the geologic formations have washed out. As shown in FIG. 7, sheath 16 plastically conforms to oval wellbore surface 50, thereby permitting a fluid tight seal between resilient material 40 and the irregularly shaped surface of wellbore surface 50.

This application of the invention is particularly advantageous over known sealing systems because the thin wall of body 22 is sufficiently elastic to conform to the irregular wellbore surface 50, without losing the integral strength provided by body 22. While conventional seal materials typically lose structural integrity as the seal element is expanded, body 22 retains structural integrity and strength despite irregular deformation of sheath 16 within an irregularly shaped wellbore surface 50. Because of this unique feature, sheath 16 can seal wellbore surface 50 against extremely high well fluid pressures.

Figure 8:
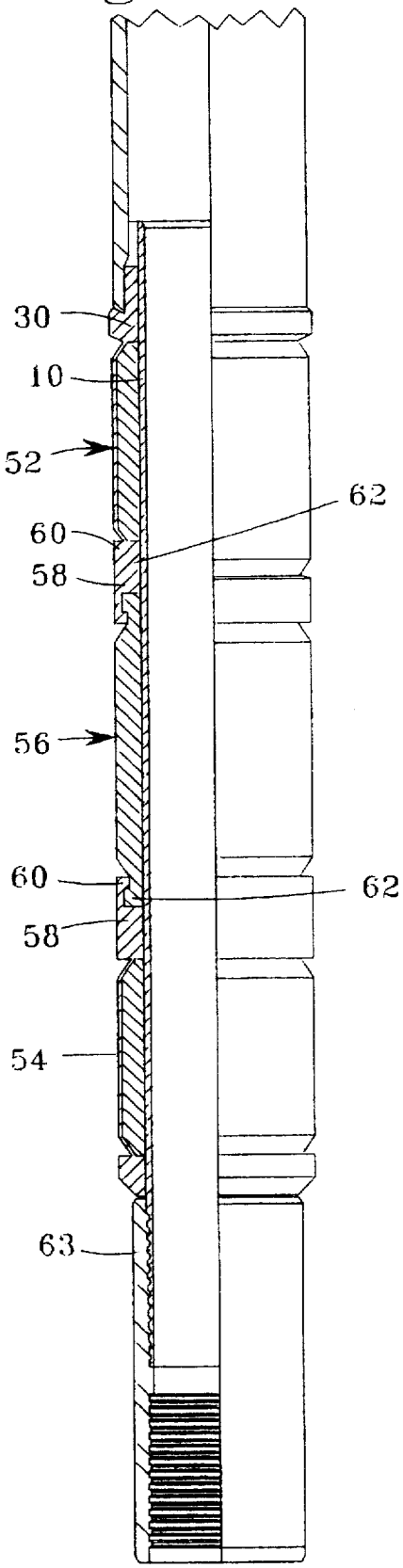
FIG. 8 illustrates an embodiment of the invention having two backup rings in combination with a conventional packing seal.
Figure 9:
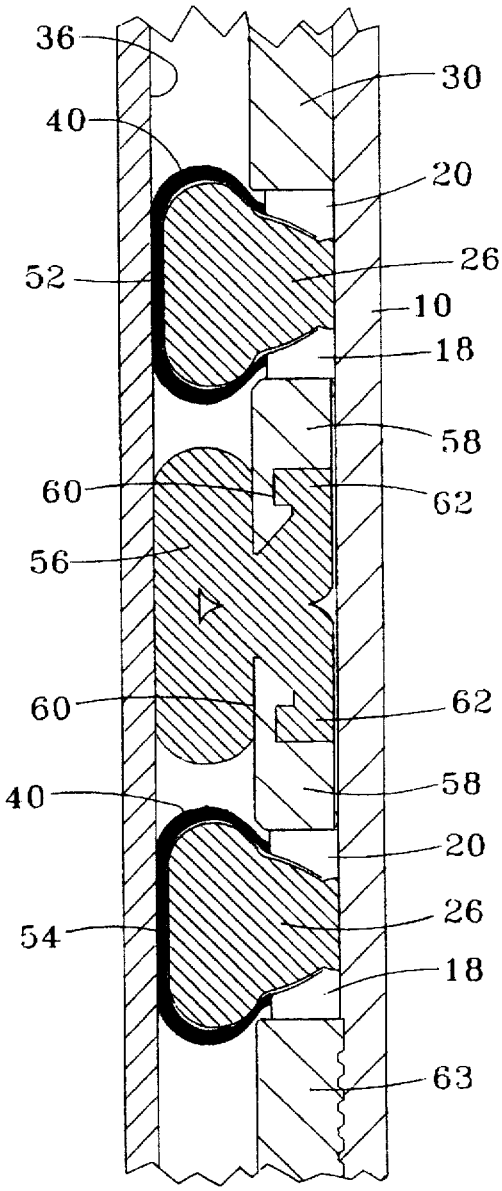
FIG. 9 illustrates the embodiment in FIG. 9 after the elements have been set against the casing.

FIG. 8 illustrates an embodiment of the invention wherein backup rings are combined with a conventional packer element. Backup ring elements 52 and 54 are positioned adjacent mandrel 10, and ring element 54 contacts well tubing 15. Conventional seal element 56 is positioned between ring elements 52 and 54, and is retained by ring inserts 58 having grooves 60 for engaging seal rings 62 at either end of seal element 56. Setting tool 30 contacts ring element 52. When setting tool 30 moves ring element 52 toward ring element 54, ring elements 52 and 54 are deformed to contact casing surface 36 as illustrated in FIG. 9, and seal element 56 also deforms to contact casing surface 36. Tubing section 63 retains ring element 52 as such elements are set. The ends of seal element 56 are retained by grooves 60. In this configuration of the invention, ring elements 52 and 54 reduce the sealing gap between mandrel 10 and casing surface 36, and therefor increase the sealing effectiveness of seal element 56 against high pressure differentials. Although ring elements 52 and 54 are not in contact with seal element 56 in FIG. 9, the relative placement of ring elements 52 and 54 could be positioned to contact seal element 56 when set.

Figure 10:
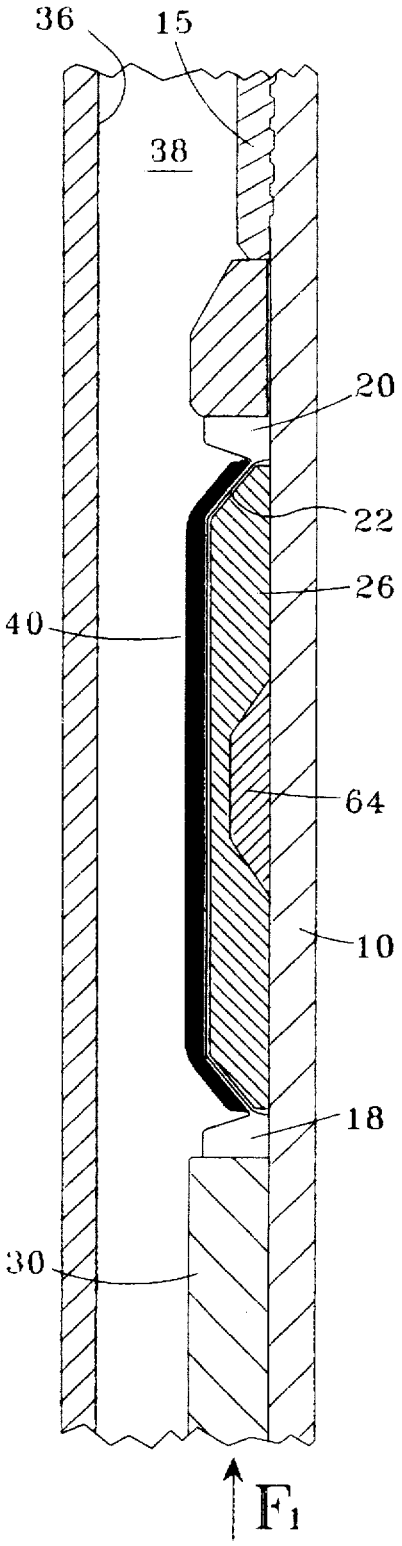
FIG. 10 illustrates an incompressible element positioned within the deformable material
Figure 11:
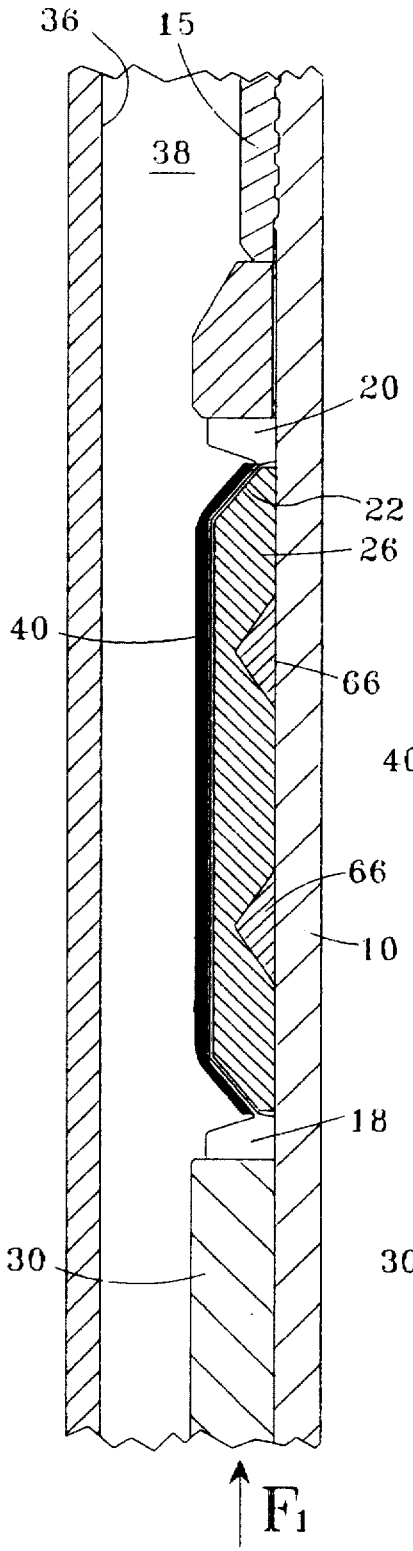
FIG. 11 illustrates more than one incompressible element positioned within the deformable material.
Figure 12:
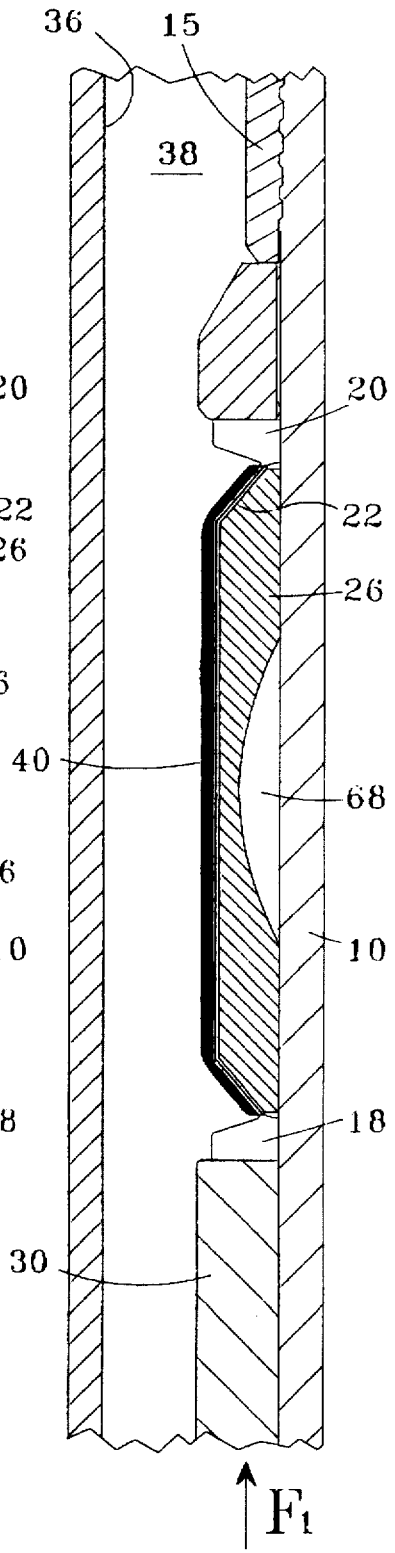
FIG. 12 illustrates a void positioned within the deformable material, and further illustrates selective positioning of a resilient material to the outside sheath surface.

FIG. 10 illustrates an embodiment of the invention wherein nondeformable insert 64 is positioned within interior volume 24. Insert 64 displaces deformable material 26 and therefore modifies the deformation of material 26 as body 22 of sheath 16 is set. Other configurations of inserts can be made, such as illustrated in FIG. 11 wherein two nondeformable inserts 66 are positioned within material 26. FIG. 12 illustrates how a void space 68 can be positioned within material 16 to modify the performance of sheath 16. More than one void space can be located, and the shape and position of void spaces can be used to selectively accomplish different purposes relative to selectively enhancing or lessening the deformation of body 22.

Figure 13:
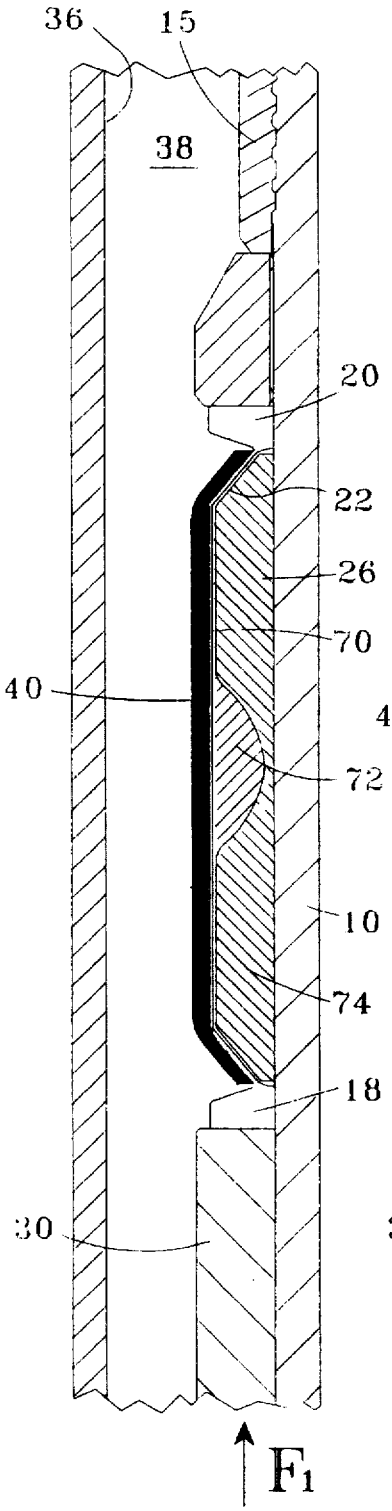
FIG. 13 illustrates a projection in the sheath body to displace the deformable material.
Figure 14:
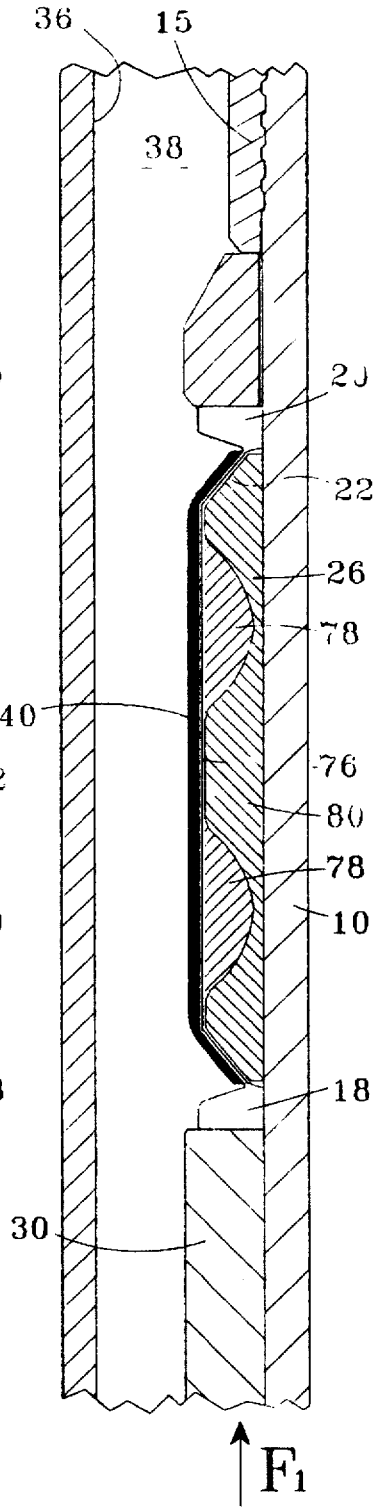
FIG. 14 illustrates more than one projection within the sheath body to displace the sheath body.

FIG. 13 illustrates an embodiment of the invention wherein sheath 16 body has a different shape. As shown in FIG. 13, sheath body 70 includes body section 72 which extends within interior volume 74 and displaces material 26. Such displacement results in a different volumetric configuration and size for interior volume 74 when compared with interior volume 24 in FIG. 1. Accordingly, the performance and movement of material 26 is different during setting operations for the embodiment in FIG. 13 than for the embodiment in FIG. 1. FIG. 14 illustrates another embodiment of the invention where sheath body 76 includes body sections 78 which extend within interior volume 80 to displace material 26.

Figure 15:
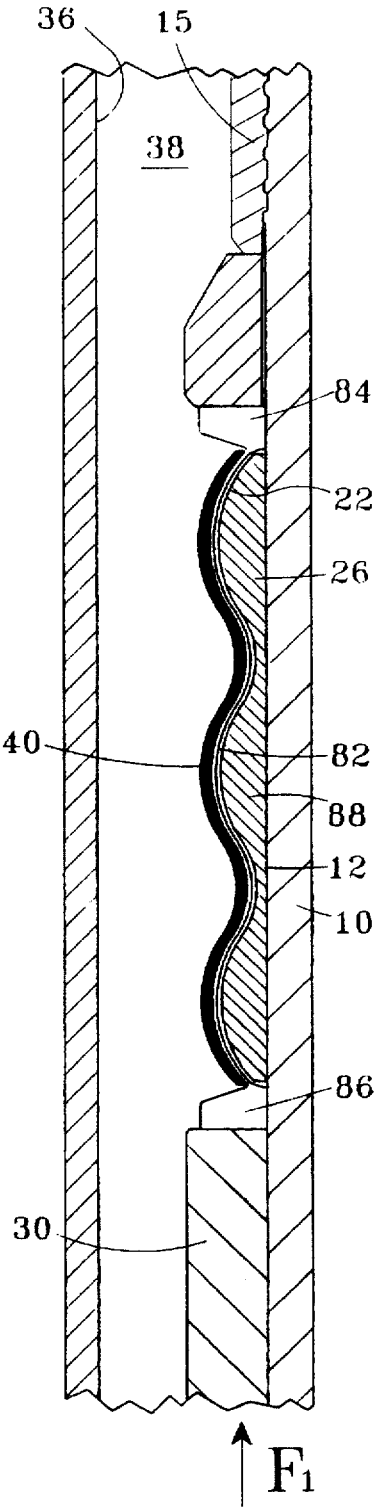
FIG. 15 illustrates one possible configuration of the sheath body.

FIG. 15 illustrates another embodiment of the invention wherein sheath body 82 is formed in another shape to modify the performance of body 82 when body first end 84 is moved toward to body second end 86. The physical configuration and composition of body 82 will influence the outward deformation of body 82 when first end 84 is moved toward second end 86. Interior volume 88 is defined by the space between body 82, first end 84, second end 86, and the exterior surface 12 of mandrel 10. Although a wave shape is illustrated, many other types of shaped and configurations could be made within the scope of the invention, and which accomplish the overall functional result of generating an element which expands to fill a space within a wellbore. Accordingly, the physical configuration and composition of body 82 can be selected to achieve different performance characteristics, including the number of contact sealing regions between resilient material 40 and casing surface 36, the relative position and length of such contact sealing regions, and the relative amount of force exerted by each sealing region against casing surface 36.

The deformation performance of body 82 can be enhanced by selecting the composition, orientation, and volume of material 26 within interior volume 88. If material 26 comprises a solid material, inserts or void spaces can be positioned within material 26 to modify the effect of material 26 on body 82 as first end 84 is moved toward second end 86 to set resilient material 40 against casing surface 36.

Figure 16:
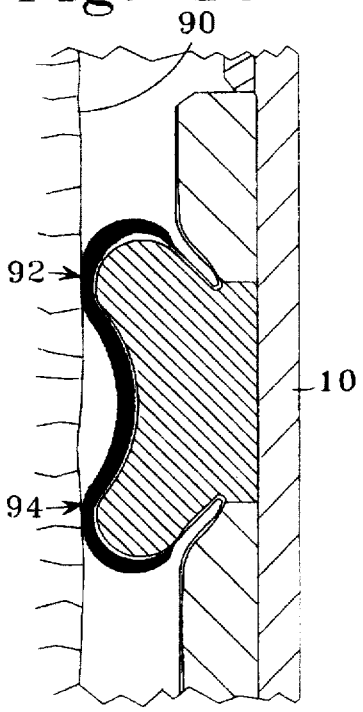
FIG. 16 illustrates one configuration of a sheath in contact with a wellbore wall surface.

FIG. 16 illustrates an embodiment of the invention in contact with borehole wall surface 90. Resilient material 40 contacts borehole surface 90 over two contact regions identified as 92 and 94. By orienting sheath 16 to seal in multiple regions, localized irregularities in borehole surface 90 can be accommodated.

Figure 17:
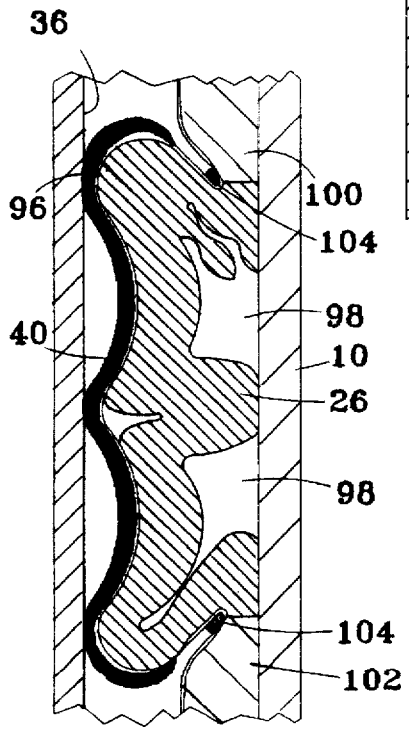
FIG. 17 illustrates void spaces within a deformable material after the sheath has been set.

FIG. 17 illustrates another embodiment of the invention wherein body 96 and attached resilient material 40 are in contact with casing surface 36. Deformable material 26 can create void spaces 98 within interior volume 24 as illustrated. First end 100 and second end 102 are each attached to body 96 through various techniques such as by welding, crimping, adhesives, or other material fastening techniques. In this embodiment of the invention, a relatively inexpensive sheet material can be used to body 96, and manufacturing costs associated with the assembly can be reduced.

Figure 18:
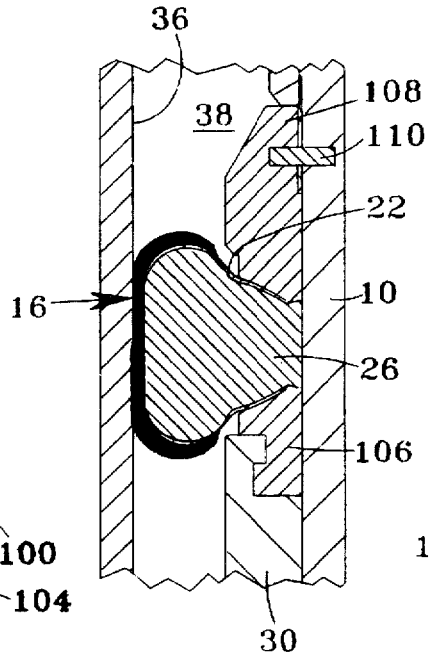
FIG. 18 illustrates the set configuration of a packer in contact with a casing surface.
Figure 19:
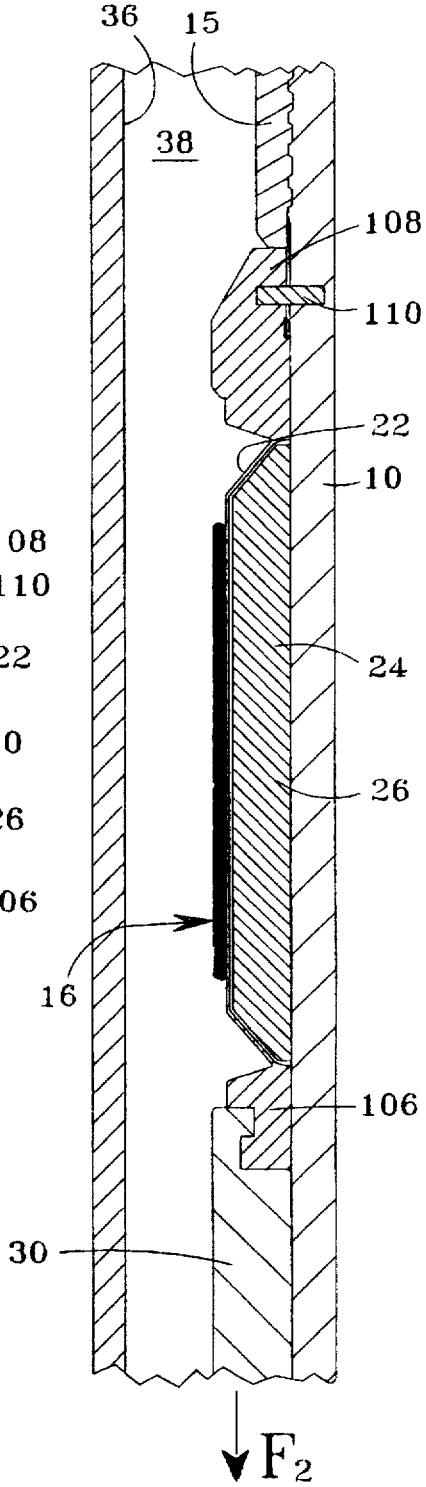
FIG. 19 illustrates the packer in FIG. 18 after the packer has been extended to disengage the packer4 from the casing surface.

FIGS. 18 and 19 illustrate the retrievable properties of the invention. Sheath 16, similar to that shown in FIG. 1, has body 22 wherein body first end 106 is attached to tool 30, and body second end 108 is fastened with shear pin 110 to mandrel 10. As shown in FIG. 18, sheath 16 is expanded to contact casing surface 36 to seal annular gap 38 between casing surface and mandrel 10.

Tool 30 can be withdrawn as shown in FIG. 19 to stretch and elongate body 22 and the deformable material 26 within interior volume 24. Force $F_2$ is provided by tool 30 in a direction opposite to the setting direction. Such movement elastically expands body 22 and deformable material 26 into an orientation similar to the original configuration before sheath 16 was initially set in the wellbore. Such removal permits the retrieval of sheath 16, and can be accomplished even if body 22 does not return to the same original condition. The elasticity of body 22, use of metals such as memory metals and other specialized alloys or compositions, will determine the configuration of body 22 after setting and retrieval, and will determine whether body 22 will be reusable for another set condition.

Figure 20:
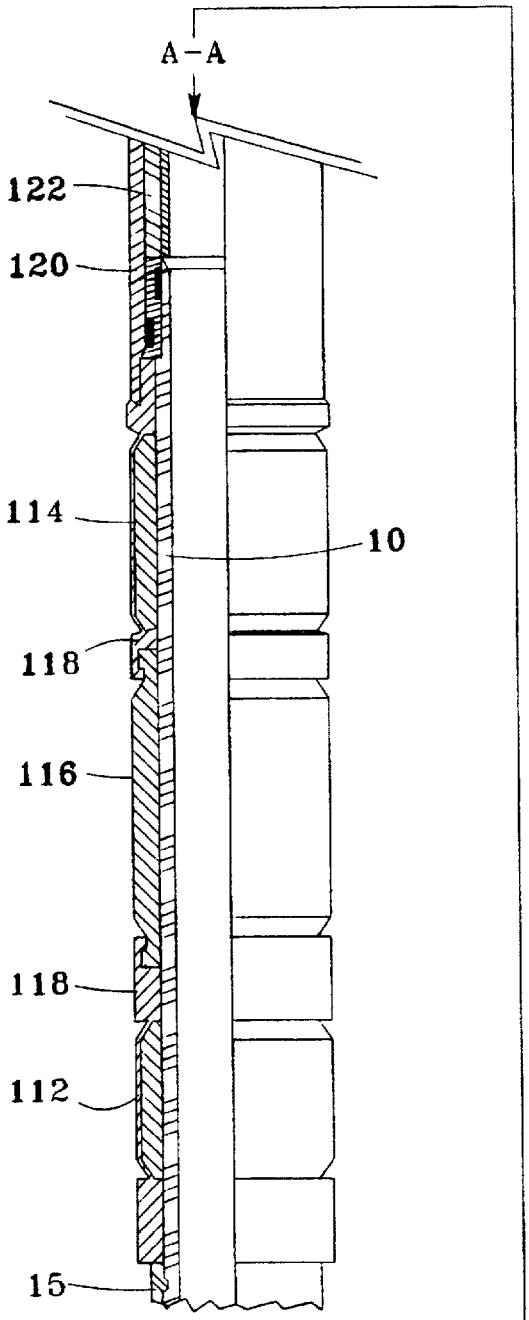
FIGS. 20 and 21 illustrate one tool configuration for setting a packer.
Figure 21:
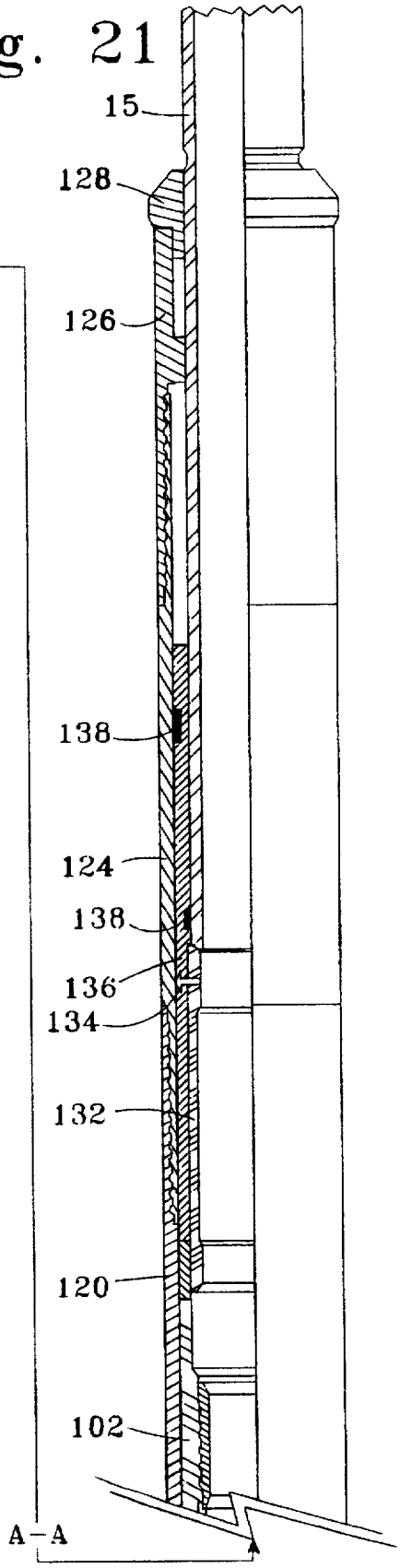

FIGS. 20 and 21, divided along section line A—A, illustrate an apparatus for implementing an inventive embodiment. Sheaths 112 and 114 are positioned proximate to mandrel 10, and packer element 116 is connected by ends 118 to sheaths 112 and 114. To set sheaths 112 and 114 and packer element 116, outer cylinder 120 is moved relative to mandrel 10 so that sheath 114 is moved toward sheath 112 as previously described. Sheath 112 is retained by tubing 15 to prevent longitudinal movement relative to mandrel 10.

Outer cylinder 120 is attached to inner cylinder 122 and is attached with a threaded connection to cylinder extension 124, which in turn is attached to cylinder extension 126. End cap 128 is attached to cylinder extension 126 and is moveable relative to the exterior surface of tubing 15 as shown in FIG. 21. Collet sleeve 132 is attached with shear pin 134 to cylinder 136, and seals 138 prevent fluid migration between tubing 15 and cylinder 136, and between cylinder 136 and cylinder extension 124. To move outer cylinder 120 toward sheath 114, a setting tool (not shown) is engaged with collet sleeve 132 and is pulled downwardly relative to FIGS. 20 and 21 as shown. Such movement of collet sleeve 132 moves cylinder 136 toward inner cylinder 122 and outer cylinder 120 to set sheaths 112 and 114 and packer element 116.

When sheaths 112 and 114 and packer element 116 have contacted casing surface 36 or borehole surface 90, further downward movement of the setting tool continues until sheaths 112 and 114 and packer element 116 exert a selected force to seal against casing surface 36 or borehole surface 90. Continued downward force by the setting tool continues until the limit of shear pin 134 is reached. At such shear limit, collet sleeve 132 separates from cylinder 136, and an operator determines that the full setting force has been achieved. Collet sleeve 132 can be removed from tubing 15, or the setting tool can be disengaged from collet sleeve 132. This feature of the invention uniquely provides positive verification to the operator that the selected setting force has been achieved at the desired setting elements, and that the wireline or tubing tension detected at the well surface is not due to other factors within the borehole environment.

Figure 22:
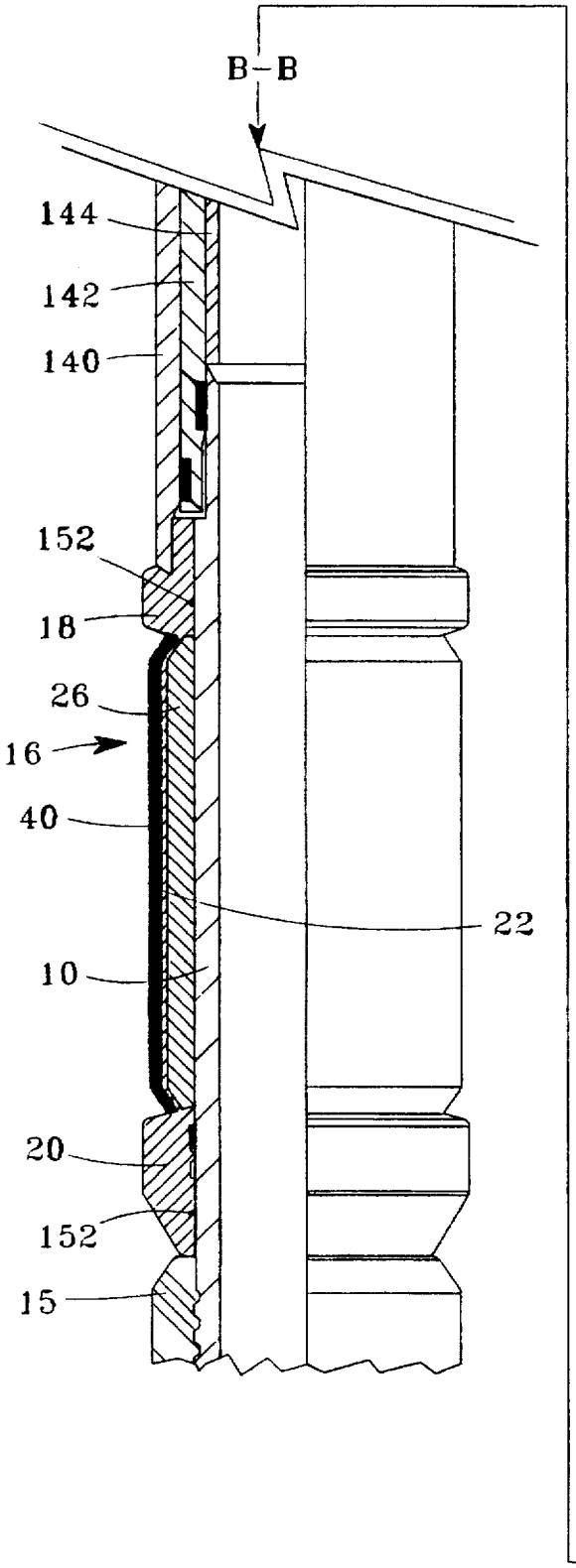
FIGS. 22 and 23 illustrate a different tool configuration for setting a packer.
Figure 23:
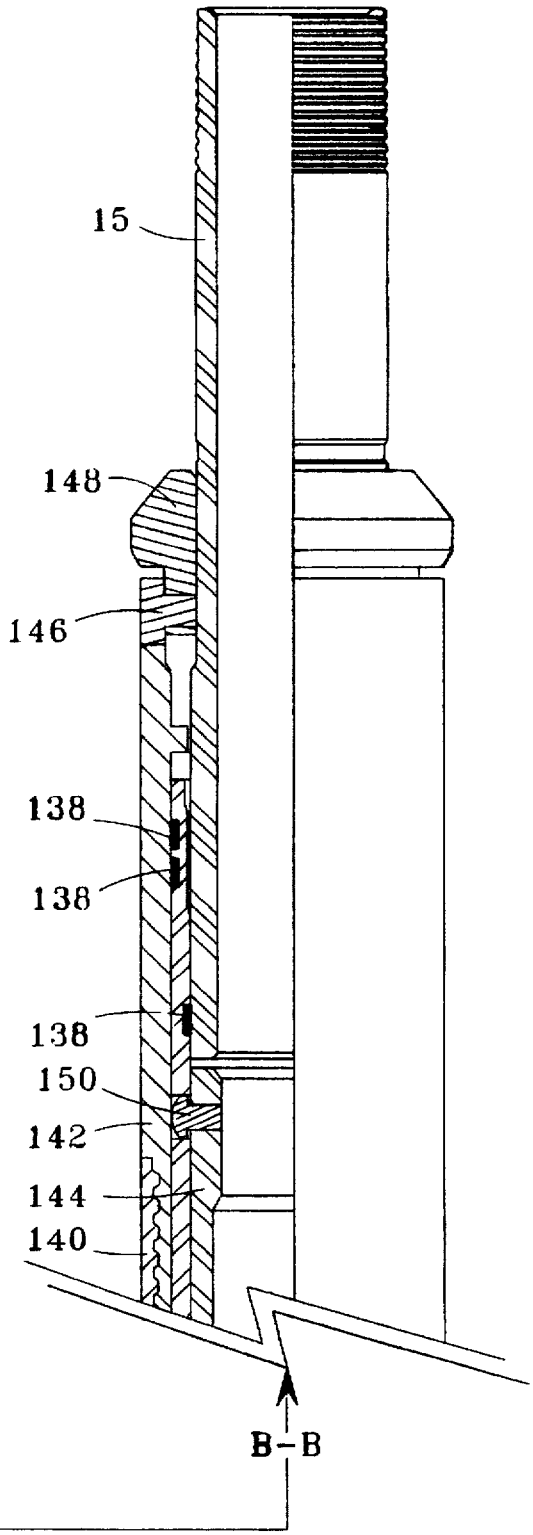

FIGS. 22 and 23, divided along section line B—B, illustrate an apparatus similar to the setting mechanism shown in FIGS. 20 and 21. Outer cylinder 140 contacts first end 18 of sheath 16, and is threadedly attached to inner cylinder 142 as shown in FIG. 23. Collet sleeve 144 is attached to inner cylinder 142, ring 146 is attached to inner cylinder 142, and end cap 148 is attached to ring 146. Shear pin 150 releasably retains collet sleeve 144 with inner cylinder 142 for the purpose described above for the embodiment shown in FIGS. 20 and 21. Seals 138 prevent fluid migration as shown and O-ring seals 152 prevent fluid migration between first end 18 and mandrel 10, and between second end 20 and mandrel 10.

Although a mechanical setting is illustrated in FIGS. 20 and 21, and FIGS. 22 and 23, other setting techniques can be utilized to set the sheaths and packers. Various mechanical mechanisms can be used wherein one element is moved toward a stationary point, or wherein opposite ends of a single or opposed multiple elements are moved toward a central point. Additionally, various hydraulic setting techniques can accomplish the same functional result of setting the elements, either by using fluid pressure or pressure differentials in the tubing, in the annulus between the tubing and the casing or wellbore surface, or by operating a downhole pressure cylinder or other form of pump to set the selected elements.

The invention provides a structure significantly less costly than conventional packer systems. When the invention is used as a backup ring in combination with a seal, the invention reduces the extrusion gap between the elements contained by the seal. When the invention is used as a fully contained packer, the invention provides a fully integrated packer which can be mechanically set without depending on absolute or differential fluids downhole in a wellbore.

In alternative embodiments of the invention, the packer elements or backup rings could be set in other ways without departing from the inventive concepts disclosed herein. For example, hydraulic setting techniques or other techniques providing the requisite setting force could be configured to set the downhole elements. After the packer elements or backup rings are set, the invention provides structural strength and stability resistant to pressure surges, downhole temperature fluctuations, or other influences.

The invention is illustrated in a cylindrical wellbore wherein the annulus between a cylindrical sleeve and the wellbore is sealed with annular backup rings or seal elements. However, the principles of the invention are adaptable to a multitude of downhole shapes. The thin wall of the sheath, and the uniform motive force provided by the deformable material permit the extrusion of the sheath in many different shapes and configurations. An oval shape is shown above in FIG. 7, and other shapes such as a planar space between adjacent tool surfaces, or irregular spaces between tool surfaces or a tool surface and the wellbore or casing wall can be filled by using the principles taught by the invention.

In other embodiments, the principles of the invention are adaptable to numerous downhole tools such as retrievable or permanent well plugs, through tubing mandrels, packers, and other well tools. The invention uniquely provides an apparatus and method which verifies the setting force of the elements, is not degraded by fluctuating pressures or temperatures, and which provides substantial flexibility in designing a settable element for a specific requirement.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

We claim:

1. An apparatus for filling a space proximate to a tool surface downhole in a wellbore, comprising:

a deformable sheath having a first end proximate to the tool surface, a second end proximate to the tool surface and moveable toward said sheath first end, and a body between said first and second ends for defining an interior volume between the tool surface and said sheath first and second ends; and a deformable material within said interior volume for moving said sheath body into the space when the sheath second end moves toward said sheath first end.

2. An apparatus as recited in claim 1, wherein said apparatus comprises a permanent packer element.

3. An apparatus as recited in claim 1, wherein said apparatus comprises a backup ring for a seal.

4. An apparatus as recited in claim 1, wherein the tool comprises a bridge plug.

5. An apparatus as recited in claim 1, wherein the tool comprises a through-tubing mandrel.

6. An apparatus as recited in claim 1, wherein said sheath is deformable to fill the space between the tool surface and the wellbore.

7. An apparatus as recited in claim 1, wherein a casing is positioned within the wellbore, and wherein said sheath is deformable to fill the space between the tool surface and casing within the wellbore.

8. An apparatus as recited in claim 1, further comprising a resilient material attached to said sheath for contacting the wellbore when the deformable material urges the sheath into the space.

9. An apparatus for filling a space proximate to a tool surface downhole in a wellbore, comprising:

a first retainer proximate to the tool surface;

a second retainer proximate to the tool surface, wherein said second retainer is moveable toward said first retainer;

a deformable sheath having a first end connected to said first retainer and having a second end connected to said second retainer, wherein said sheath defines an interior volume between said sheath and the tool surface and between said first and second retainers; and a deformable material within said interior volume, wherein said material deforms, when said second retainer is moved toward said first retainer, to move said sheath into the space proximate to the tool surface.

10. An apparatus as recited in claim 9, wherein said sheath fills a space between different surfaces of the well tool.

11. An apparatus as recited in claim 9, further comprising a resilient material attached to said sheath for providing a seal between the tool surface and the wellbore.

12. A packer for filling a selected space downhole in a wellbore, comprising:

a sleeve for placement downhole in the wellbore, wherein said sleeve has an exterior surface;

a first retainer proximate to said sleeve exterior surface;

a second retainer proximate to said sleeve exterior surface, wherein said second retainer is moveable toward said first retainer;

a deformable sheath having a first end connected to said first retainer and having a second end connected to said second retainer, wherein said sheath defines an interior volume between said sheath and said exterior surface and between said first and second retainers; and a deformable material within said interior volume, wherein said material deforms, when said second retainer is moved toward said first retainer, to move said sheath into the wellbore downhole space.

13. A packer as recited in claim 12, further comprising a seal element proximate to said sheath for preventing fluid migration past the tool surface.

14. A packer as recited in claim 13, wherein said seal element contacts the wellbore surface and prevents fluid migration between the wellbore surface and the tool surface.

15. A method for filling a space proximate to a tool surface downhole in a wellbore, comprising the steps of:

positioning a deformable sheath proximate to the tool surface to define an interior volume between the tool surface, a sheath body, and first and second ends of said sheath, wherein said interior volume contains a deformable material; and moving said second sheath end toward said first sheath end to deform said sheath body into the space, wherein movement of said second sheath end toward said first sheath end deforms said material to move said sheath into the space.

16. A method as recited in claim 15, wherein said sheath is moved into the space until said sheath contacts the wellbore.

17. A method as recited in claim 16, wherein a resilient material is attached to said sheath between said sheath and the wellbore, further comprising the step of moving the sheath and said resilient material against the wellbore to create a fluid tight seal between the tool surface and the wellbore.

18. A method as recited in claim 15, further comprising the step of moving said sheath toward said sheath first end with a tool controlled from the wellbore surface.

19. A method as recited in claim 18, further comprising the step of shearing a shear pin having a selected yield strength when said sheath body is fully moved into the space.

* * * * *